US007863509B2

(12) United States Patent
Rovner

(10) Patent No.: US 7,863,509 B2
(45) Date of Patent: Jan. 4, 2011

(54) MASS-LOADED LIGATURE FOR WOODWIND INSTRUMENTS

(76) Inventor: Philip Lee Rovner, 23 Tintern Ct., #301, Timonium, MD (US) 21093

( * ) Notice: Subject to any disclaimer, the term of this patent is extended or adjusted under 35 U.S.C. 154(b) by 0 days.

(21) Appl. No.: 12/040,969

(22) Filed: Mar. 3, 2008

(65) Prior Publication Data

US 2009/0217798 A1 Sep. 3, 2009

(51) Int. Cl.
*G10D 9/02* (2006.01)

(52) U.S. Cl. ..... 84/383 R

(58) Field of Classification Search ..... 84/383 R
See application file for complete search history.

(56) References Cited

U.S. PATENT DOCUMENTS

| | | | | | |
|---|---|---|---|---|---|
| 2,499,855 | A | * | 3/1950 | Gamble | 84/383 R |
| 3,905,268 | A | * | 9/1975 | Gamble | 84/383 R |
| 4,210,055 | A | * | 7/1980 | Platamone, Jr. | 84/383 R |
| 4,428,271 | A | * | 1/1984 | Winslow et al. | 84/383 R |
| 4,517,875 | A | * | 5/1985 | Dossekker | 84/383 R |
| 5,018,425 | A | | 5/1991 | Rovner | |
| 5,192,821 | A | | 3/1993 | Goldstein et al. | |
| 5,289,752 | A | * | 3/1994 | Barbaglia | 84/383 R |
| 5,357,837 | A | | 10/1994 | Disera | |
| 5,398,582 | A | * | 3/1995 | Smith | 84/383 R |
| 5,419,229 | A | | 5/1995 | Van Doren | |
| 5,623,111 | A | | 4/1997 | Van Doren et al. | |
| 5,728,957 | A | * | 3/1998 | Valtchev | 84/383 R |
| 5,973,245 | A | * | 10/1999 | Van Doren | 84/383 R |
| 5,998,715 | A | * | 12/1999 | Rovner | 84/383 R |
| 6,020,545 | A | * | 2/2000 | Consoli | 84/383 R |
| 6,118,060 | A | | 9/2000 | Van Doren | |
| 6,130,376 | A | * | 10/2000 | Chang | 84/383 R |
| 6,150,593 | A | * | 11/2000 | Holden | 84/383 R |
| 6,673,992 | B1 | * | 1/2004 | Runyon | 84/383 A |
| 7,169,993 | B2 | * | 1/2007 | Fliegel et al. | 84/383 A |
| 2005/0061136 | A1 | * | 3/2005 | Rovner | 84/383 A |
| 2008/0022839 | A1 | * | 1/2008 | Sullivan | 84/383 R |
| 2009/0217798 | A1 | * | 9/2009 | Rovner | 84/383 R |
| 2010/0043621 | A1 | * | 2/2010 | Rovner | 84/383 R |

OTHER PUBLICATIONS

Rovner Ligatures, viewed May 14, 2010 at www.rovnerproducts.com/ligatures.com.*

Passband, http://www.absoluteastronomy.com/topics/Passband viewed May 14, 2010.*

* cited by examiner

*Primary Examiner*—Elvin G Enad
*Assistant Examiner*—Robert W Horn
(74) *Attorney, Agent, or Firm*—August Law, LLC; George Willinghan

(57) ABSTRACT

A mass-loaded ligature is provided for use in a mouthpiece system for attaching a reed to a mouthpiece of a woodwind musical instrument. The ligature is constructed from a flexible strap of material, either metal or rubberized fabric, having two ends to which large masses are fixedly secured. The ends of the straps and masses are brought together to form a loop that is placed over the mouthpiece and reed. A threaded closure mechanism is used to tighten the ligature around the mouthpiece. The ends of the strap are folded over and crimped into slots in the masses to secure the masses to the strap.

15 Claims, 6 Drawing Sheets

MASS-LOADED LIGATURE FOR WOODWIND INSTRUMENTS

FIELD OF THE INVENTION

The present invention relates to woodwind instruments and in particular to mouthpieces for woodwind instruments.

BACKGROUND OF THE INVENTION

Woodwind musical instruments, e.g., saxophones and clarinets, and other devices such as bird calls utilize the vibration of a reed in response to a flow of air to generate a tone. These reeds include natural cane reeds and synthetic reeds. Tone generation in general depends on proper reed vibration. The reed is typically placed in contact with a mouthpiece to cover an opening or window. The reed is held in place by an adjustable clamp or ligature that surrounds the mouthpiece and the reed. Variations in the mouthpiece and ligature affect the vibration of the reed and, therefore, the performance or tone of the device or instrument. Various ligatures have been proposed largely to improve the overall performance of the instrument.

In any device that is part of a vibrating system, differences in materials and construction yield different vibrational patterns and tonal spectrums. In a typical prior art ligature, the configuration was premised largely on the objective of permitting the reed to vibrate with greater freedom and less constriction. In U.S. Pat. No. 5,998,715, the tone is altered in accordance with user preference by alternating the weight of the cradle that interfaced the reed. This arrangement demonstrated that variations in the mass of the ligature construction influence the performance of the ligature. However, the arrangement was complex in that the fastening elements at the end of the body were not utilized effectively in mass-loading the ligature in the region of the reed.

SUMMARY OF THE INVENTION

The present invention is directed to ligatures and mouthpiece systems utilizing these ligatures that provide for increased performance in a woodwind instruments through the reduction of interfering vibrational frequencies from the ligature. A ligature is provided that includes a strap or body made of any suitable material, for example sheet metal, a rubberized fabric sheet or sheet plastic. The unitary strap encircles the mouthpiece and reed, and the ends of the strap terminate in relatively large masses that are in the form of cylindrical rods. An overlap or reverse bend is configured adjacent to each rod, and the ends of the ligature are affixed to the rods by suitable means. Preferably, the overlapped ends of the strap are crimped into slots in the rods. For metallic straps, a small cushion made of a resilient material, such as rubber, is located within the slots between the layers of overlapped strap. When the strap is fabric, a resilient metal shim is located between the overlapping layers in the slot.

A plurality of parallel slots or slits are incorporated into the strap adjacent the ends in of the reverse bend. A fastening or closure mechanism is provided that passes through holes in each rod to permit affixing the ligature to the reed and mouthpiece. When the ligature is assembled to the mouthpiece and reed, the inner surface of the ligature body presses on the reed in a highly compliant manner as a result of the tightening pressure exerted upon the cushion and the ligature body by the rods. The relatively heavy rods in conjunction with the compliance features lower the frequency band of the internal resonances of the ligature, improving the tonal quality, playing freedom, intonation, and response of the instrument.

In accordance with one embodiment, the present invention is directed to a ligature for a mouthpiece. The ligature includes a loop made from a thin resilient flexible strap having two ends. The loop sized to encircle a mouthpiece. A mass is attached to the strap and has a sufficient weight to lower passband frequencies of internal resonances of the ligature sufficiently below passband frequencies of a vibrating reed secured to the mouthpiece by the ligature. In one embodiment, the mass is disposed on at least one of the two ends of the strap. Alternatively, the mass is two substantially equal masses, and each one of the two masses is attached to one of the two ends of the strap. Suitable shapes for the masses include cylindrical rods.

In one embodiment, the strap further has two parallel sides running between the two ends, and each cylindrical rod is aligned along each end to intersect each one of the two parallel sides at an angle other than 90° to create a frusto-conical shaped loop that accommodates a tapered mouthpiece. In one embodiment, each mass further includes a slot, and the corresponding end of the strap attached to each mass is disposed and securely anchored in the slot. In one embodiment, the strap is made from a rubberized fabric, and each end of the strap includes an overlapping fold forming two layers of the strap. Both of the layers are disposed within the slot. A metal shim can be provided between the two layers of the strap at each end of the strap. In another embodiment, the strap is a metal strap, and each end of the strap includes an overlapping fold forming two layers of the strap. Both layers disposed within the slot. A strip of rubberized fabric can be provided between the two layers of the strap at each end of the strap.

In one embodiment, each mass is a cylindrical rod, and each slot extends along an entire length of the cylindrical rod and partially into the cylindrical rod along a non-diametric secant line. The ends of the strap are disposed over the reed when the ligature is attached to the mouthpiece, and the non-diametric secant line intersects a plane tangent to the outer surface of the reed at a point between the two ends of the ligature at an angle of from about 40° to about 45°.

The present invention is also directed to a woodwind mouthpiece system that includes a mouthpiece, a reed in contact with the mouthpiece and a ligature surrounding the mouthpiece and the reed to secure the reed to the mouthpiece. The ligature includes a loop of a thin resilient flexible strap having two ends. The loop encircles the mouthpiece, and the ends of the strap are disposed over the reed. The mouthpiece system also includes two substantially equal masses. Each mass is attached to one of the ends of the ends of the strap and is spaced from the reed. The two masses in combination provide enough weight to lower passband frequencies of internal resonances of the ligature sufficiently below passband frequencies of the reed when vibrating.

In one embodiment, each mass further includes a slot running along its length. The corresponding end of the strap attached to each mass is disposed and securely anchored in the slot. In one embodiment, the strap is a rubberized fabric, and each end of the strap includes an overlapping fold forming two layers of the strap. Both layers are disposed within the slot, and a metal shim can be provided between the two layers of the strap at each end of the strap. In one embodiment, the strap is metal, and each end of the strap includes an overlapping fold forming two layers of the strap. Both layers are disposed within the slot, and a strip of rubberized fabric is disposed between the two layers of the strap at each end of the strap. In one embodiment, each mass is a cylindrical rod, and each slot extends along an entire length of the cylindrical rod and partially into the cylindrical rod along a non-diametric secant line. The ends of the strap are disposed over the reed when the ligature is attached to the mouthpiece, and the non-diametric secant line intersects a plane tangent to the outer surface of the reed at a point between the two ends of the ligature at an angle of from about 40° to about 45°.

DETAILED DESCRIPTION

Figure 1:
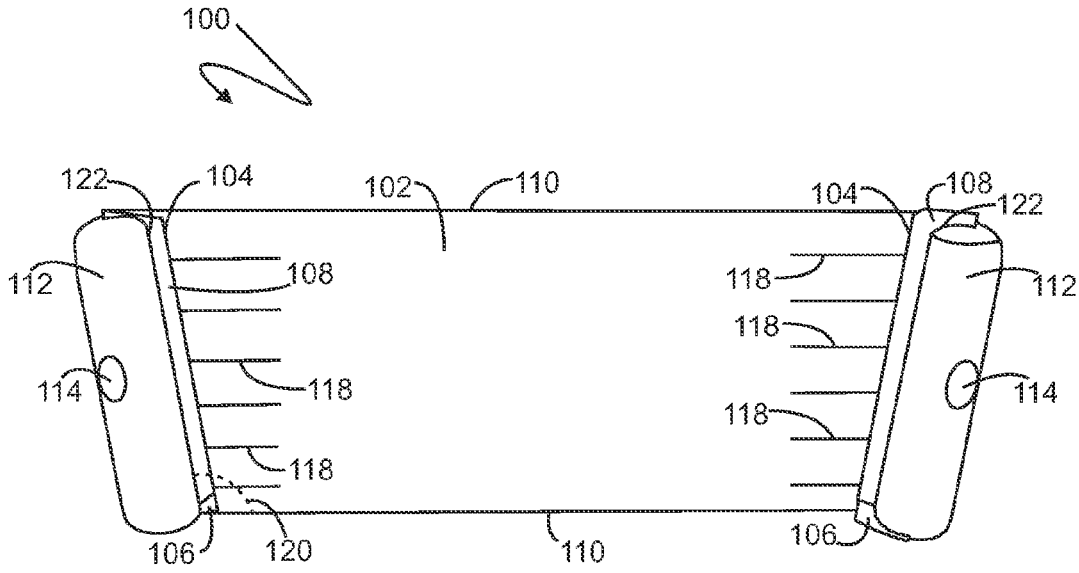
FIG. 1 is a plan view of a first side of an embodiment of a ligature in accordance with the present invention.
Figure 2:
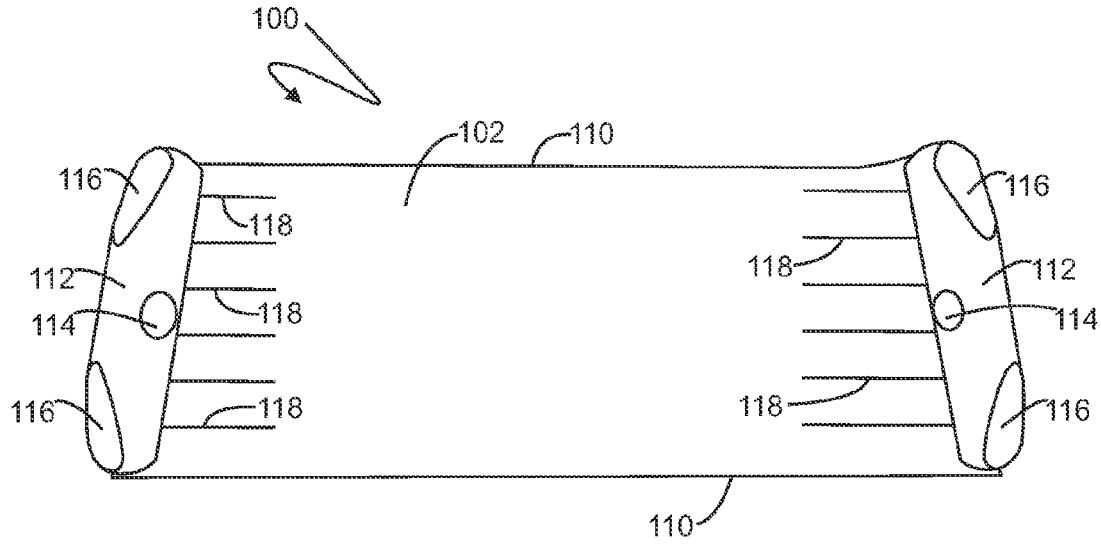
FIG. 2 is a plan view of a second side of the ligature of FIG. 1.

Referring initially to FIGS. 1 and 2, an exemplary embodiment of a ligature 100 in accordance with the present invention is illustrated. The ligature is used to secure reeds to a mouthpiece for use with a woodwind instrument, e.g., a clarinet or saxophone, or any other type of device where a vibrating reed is secured to a mouthpiece. The ligature includes a thin resilient flexible strap 102 having two opposite ends 104. As illustrated, the thin flexible strap is generally rectangular in shape; however, the strap can be other shapes including square, circular or trapezoidal. The strap is sized in accordance with the size of the mouthpiece to which the ligature is applied. In one embodiment, the flexible strap is about 1" to about 1.25" wide and about 3.5" to about 4" long. In one embodiment, the flexible strap has a thickness of about 0.035". Preferably, width of the ligature strap is selected to span as much of the length of the reed as possible to decrease the unit pressure of the strap in contact with the reed. A decrease in unit contact pressure on the reed, allows the reed to vibrate more freely. Suitable materials for the flexible strap include, but are not limited to polymers, elastomers, metals and combinations thereof. As illustrated in FIGS. 1 and 2, the flexible strap is a rubberized fabric sheet. The flexible strap can be formed into a loop by bringing the two ends together. The loop is sized to encircle a mouthpiece. At either end of the flexible strap is a plurality of generally parallel slits 118. Each slit runs from one of the ends a given distance into the strap in a direction that is generally parallel to the two parallel sides 110 of the flexible strap. As illustrated, each end contains six slits. The slits contribute additional compliance or form-fitting flexibility to the strap to enhance the function of the ligature. The number of slits provided on each end can be varied depending on the amount of compliance desired or required.

In one embodiment, the ligature includes at least one mass 112 attached along the strap. Alternatively, a plurality of masses is attached along the flexible strap. Preferably, the ligature includes two masses. In one embodiment, the masses are substantially equal. The mass or combination of masses, in combination with the high compliance construction of the ligature strap, provides sufficient weight to the ligature to lower the passband frequencies of internal resonances of the ligature sufficiently below passband frequencies of the vibrating reed that is secured to the mouthpiece by the ligature. In general, the weight of the mass is significantly more than the weight of the flexible strap. In one embodiment, the ligature contains one mass attached to at least one of the ends of the flexible strap. In another embodiment, the ligature includes two masses, each attached to one of the ends, i.e., opposite ends of the flexible strap.

Suitable materials for the mass include any material that can produce an adequate amount of weight to achieve the desired passband frequency reduction within the space constraints of a mouthpiece. Preferably, the mass is metal. Suitable metals include, but are not limited to, copper, brass and stainless steel. In one embodiment, each mass is constructed from cylindrical bar stock having a diameter of from about 0.25" to about 0.5" and preferably about 0.375". The length of each cylindrical mass is from about 1" to about 1.5" and preferably about 1.25". The mass can also be a rectangular or square rod or any other elongated shape. In one embodiment, each mass includes at least one diametric hole 114 disposed along the length of the cylindrical mass. When one diametric hole is included in each mass, the hole is located generally at the midpoint along the length of the cylindrical mass. In one embodiment, each hole has a diameter of about 0.15". In one embodiment, both ends of each mass include tapers 116, cutouts, bevels or chamfers. These two tapers can be used to adjust, i.e., remove, mass. In addition, the tapers provide clearance for the chin of a user when the ligature is attached a mouthpiece. In one embodiment, all of the masses are identical in size, weight and configuration. Since a mass may have to be rotated 180° depending on the end of the flexible strap to which it is attached, having identical tapers on either end of each mass facilitates placement of any given mass on either end of a flexible strap.

Each mass can be fixedly or removable secured to a given end of the flexible strap. Having masses removably attached facilitates exchanging or replacing masses. Preferably, each mass is fixedly secured to a given end of the flexible strap. Suitable attachment mechanisms include, but are not limited to, fasteners such as rivets and adhesives. In one embodiment, a slot 122, having for example a "U" shaped or rectangular cross section, is provided along the length of each mass. Each slot can extend either partially or entirely along the length of each mass and extends into the mass, for example either diametrically or non-diametrically. In one embodiment, each slot has a depth that extends partially into the cylindrical rod along a non-diametric secant line.

The ends of the flexible strap are inserted into the slot, and the mass is crimped closed on the strap, securely anchoring the strap into the mass. In this embodiment, the material of the strap provides the desired cushioning and vibrational isolation or dampening between each mass and the mouthpiece to which the ligature is attached. In one embodiment, an overlap 108 is provided at each end to form two layers of the flexible strap that are inserted into the slot. Overlapping increases the level of cushioning as well as the stability of the bond between the mass and the strap. In additional a rigid insert 106 is provided between the overlapping layers at the ends of the flexible strap. The rigid insert also improves the stability of the attachment between the flexible strap and the mass. Suitable materials for the rigid insert include rigid plastics and metals including brass and stainless steel. In one embodiment, the rigid insert is a metal shim having a thickness of less than about 0.0625" and preferably about 0.01". Although each mass can be attached to the flexible strap so that the mass intersect the sides 110 of the flexible strap at an angle 120 of about 90°, preferably the mass, i.e., the long axis of the cylindrical rod from which the mass is created, is aligned along each end to intersect each one of the two parallel sides at an angle 120 other than 90°. This creates a loop having a frusto-conical shape that accommodates for a tapered mouthpiece.

Figure 3:
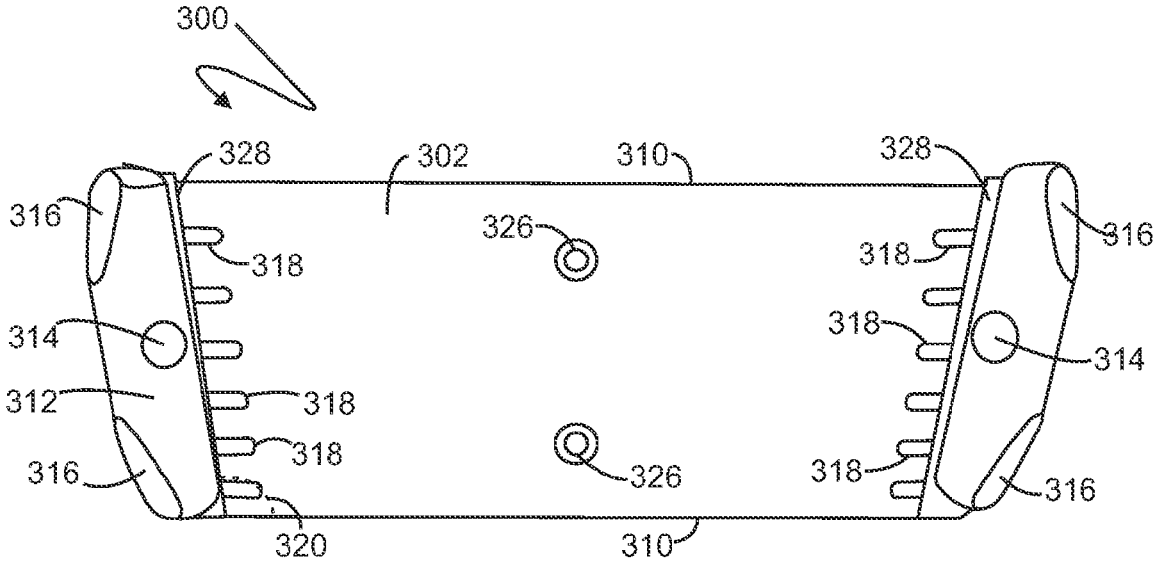
FIG. 3 is a plan view of a first side of another embodiment of a ligature in accordance with the present invention.
Figure 4:
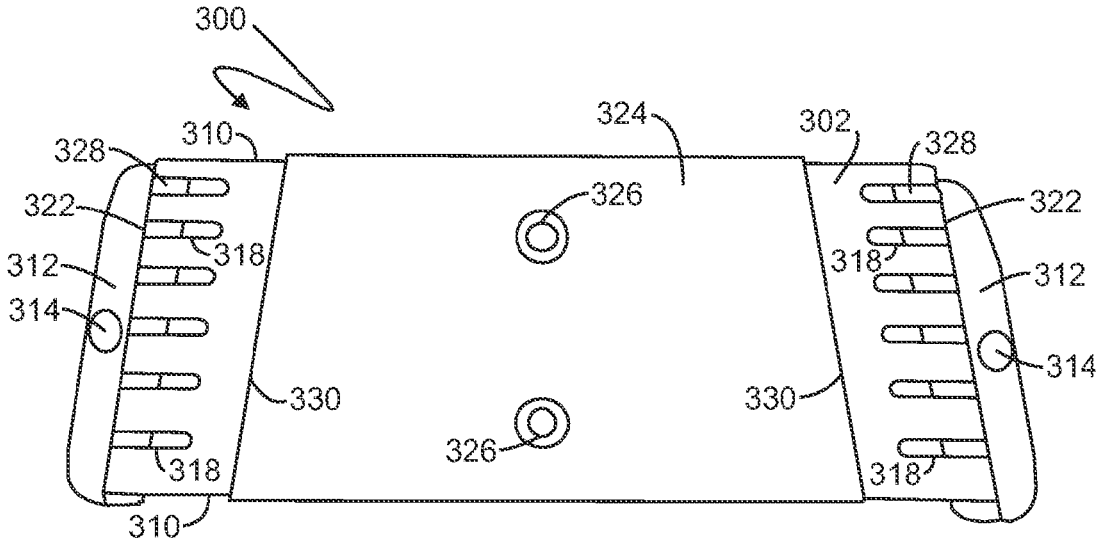
FIG. 4 is a plan view of a second side of the ligature of FIG. 3.

Referring to FIGS. 3 and 4, an exemplary embodiment of the ligature 300 of the present invention is illustrated, where the flexible or bendable strap 302 is thin metal. Suitable metals include copper, brass and stainless steel. As illustrated, the thin flexible strap is generally rectangular in shape; however, the strap can be other shapes including square, circular or trapezoidal. The strap is sized in accordance with the size of the mouthpiece to which the ligature is applied. In one embodiment, the flexible strap is about 1" to about 1.25" wide and about 3.5" to about 4" long. In one embodiment, the flexible strap has a thickness of about less than about 0.0625" and preferably about 0.01". The flexible strap can be formed into a loop by bringing the two ends together. The loop is sized to encircle a mouthpiece. Attached to an inner surface of the flexible strap is a cushioning or vibration dampening material 324. Suitable materials include polymers, elastomers and rubberized fabrics. The cushioning material is fixedly secured to the flexible strap, for example using a plurality of rivets 326 and is positioned to be between the flexible strap and the mouthpiece. The cushioning material is as wide as the flexible strap, and the length is length than the length of the flexible strap with ends 330 that generally parallel the ends of masses 312 of the ligature.

At either end of the flexible strap is a plurality of generally parallel slots 318 that have been cut out of the flexible metallic strap. Each slot runs from one of the ends a given distance into the strap in a direction that is generally parallel to the two parallel sides 310 of the flexible strap. As illustrated, each end contains six slots. The slots contribute additional compliance or form fitting flexibility to the strap to enhance the function of the ligature. The number of slots provided on each end can be varied depending on the amount of compliance desired or required.

In one embodiment, the ligature includes at least one mass 312 attached along the strap. Alternatively, a plurality of masses is attached along the flexible strap. Preferably, the ligature includes two masses. In one embodiment, the masses are substantially equal. The mass or combination of masses provides sufficient weight to the ligature to lower the passband frequencies of internal resonances of the ligature sufficiently below passband frequencies of the vibrating reed that is secured to the mouthpiece by the ligature. In general, the weight of the mass is significantly more than the weight of the flexible strap. In one embodiment, the ligature contains one mass attached to at least one of the ends of the flexible strap. In another embodiment, the ligature includes two masses, each attached to one of the ends of the flexible strap.

Suitable materials for the mass include any material that can produce an adequate amount of weight to achieve the desired passband frequency reduction within the space constraints of a mouthpiece. Preferably, the mass is metal. Suitable metals include, but are not limited to, copper, brass and stainless steel. In one embodiment, each mass is constructed from cylindrical bar stock having a diameter of from about 0.25" to about 0.5" and preferably about 0.375". The length of each cylindrical mass is from about 1" to about 1.5" and preferably about 1.25". The mass can also be a rectangular or square rod or any other elongated shaped. In one embodiment, each mass includes at least one diametric hole 314 disposed along the length of the cylindrical mass. When one diametric hole is included in each mass, the hole is located generally at the midpoint along the length of the cylindrical mass. In one embodiment, each hole has a diameter of about 0.15". In one embodiment, both ends of each mass include tapers 316, cutouts, bevels or chamfers. These two tapers can be used to adjust, i.e., remove, mass. In addition, the tapers provide clearance for the chin of a user when the ligature is attached a mouthpiece. In one embodiment, all of the masses are identical in size, weight and configuration. Since a mass may have to be rotated 180° depending on the end of the flexible strap to which it is attached, having identical tapers on either end of each mass facilitates placement of any given mass on either end of a flexible strap.

Each mass can be fixedly or removable secured to a given end of the flexible strap. Having masses removably attached facilitates exchanging or replacing masses. Preferably, each mass is fixedly secured to a given end of the flexible strap. Suitable attachment mechanisms include, but are not limited to, fasteners such as rivets and adhesives. In one embodiment, a slot 322, having for example a "U" shaped or rectangular cross section, is provided along the length of each mass. Each slot can extend either partially or entirely along the length of each mass and extends into the mass, for example either diametrically or non-diametrically. In one embodiment, each slot has a depth that extends partially into the cylindrical rod along a non-diametric secant line.

The ends of the flexible strap are inserted into the slot, and the mass is crimped closed on the strap, securely anchoring the strap into the mass. In this embodiment, the material of the strap provides the desired cushioning and vibrational isolation or dampening between each mass and the mouthpiece to which the ligature is attached. In one embodiment, an overlap is provided at each end to form two layers of the flexible strap that are inserted into the slot. Overlapping increases the stability of the bond between the mass and the strap. In additional a flexible insert 328 is provided between the overlapping layers at the ends of the flexible strap. Suitable materials for the flexible insert include polymers, elastomers and rubberized fabric. In one embodiment, the material of the flexible insert is the same as the material of the cushioning insert. In one embodiment, the flexible insert has a thickness of less than about 0.0625" and preferably about 0.035". Although each mass can be attached to the flexible strap so that the mass intersect the sides 310 of the flexible strap at an angle 320 of about 90°, preferably each mass, i.e., the cylindrical rod from which the mass is created, is aligned along each end to intersect each one of the two parallel sides at an angle 320 other than 90°. This creates a loop having a frusto-conical shape that accommodates for a tapered mouthpiece.

Figure 5:
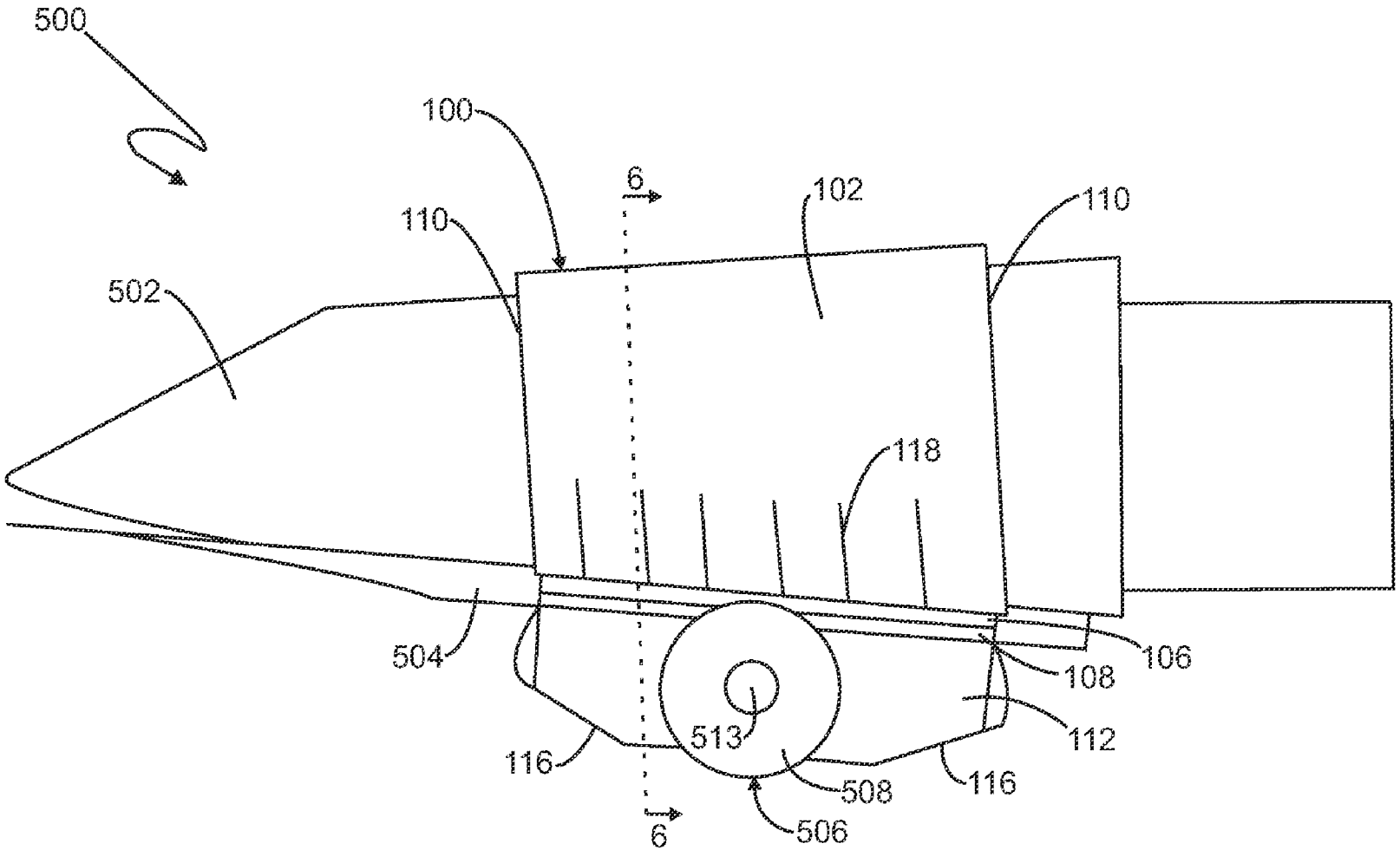
FIG. 5 is a side view of an embodiment of a mouthpiece system utilizing the ligature of FIG. 1.
Figure 6:
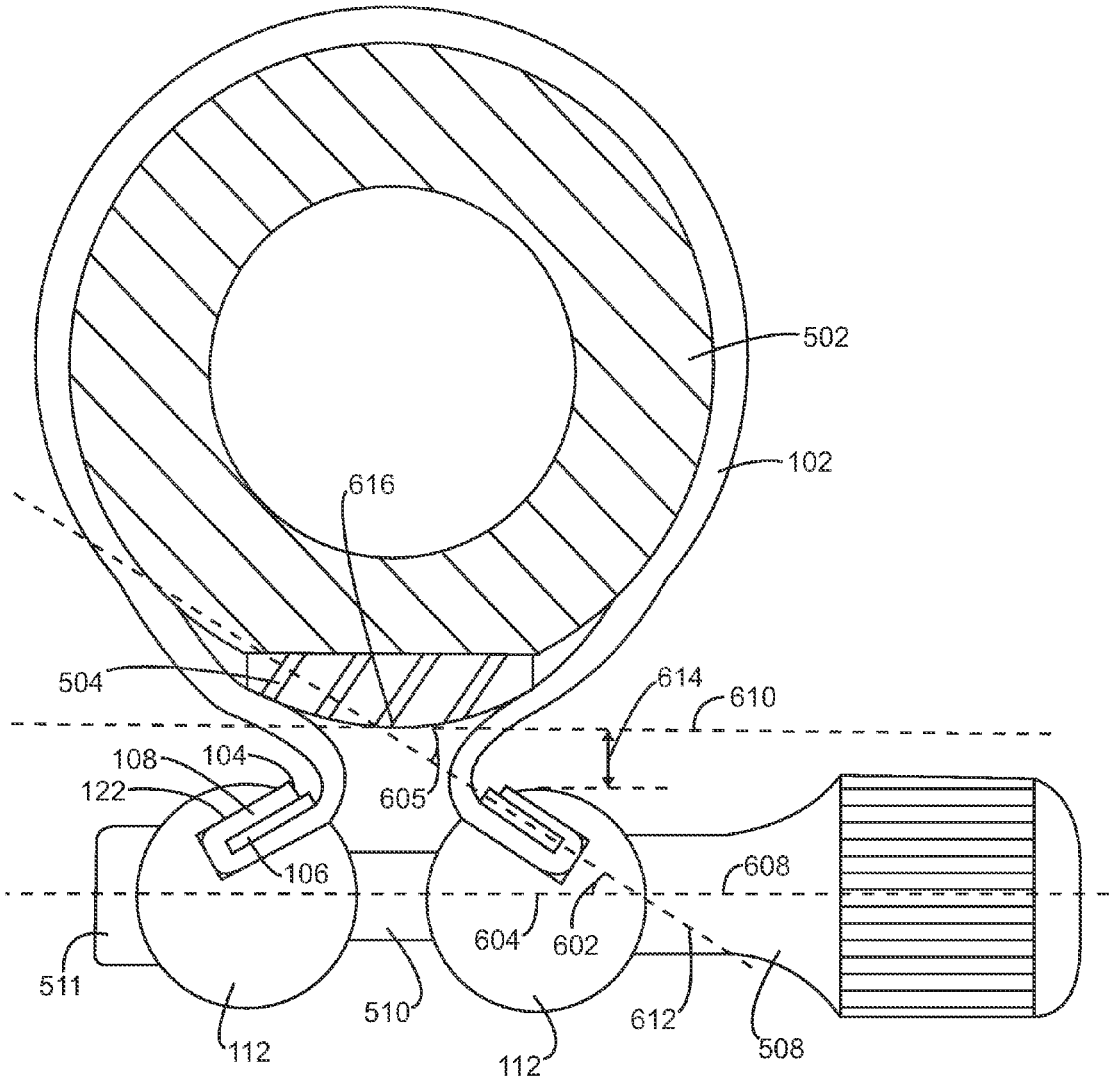
FIG. 6 is a view through line 6-6 of FIG. 5.

Referring to FIGS. 5 and 6, an exemplary embodiment of a woodwind mouthpiece system 500 utilizing the ligature in accordance with the present invention is illustrated. The system includes a mouthpiece 502, a reed 504 in contact with the mouthpiece and a ligature 100 surrounding the mouthpiece and the reed to secure the reed to the mouthpiece. In this embodiment, the ligature illustrated in FIGS. 1 and 2 is used. As illustrated, the ends of the flexible strap 102 are disposed over the reed 504 when the ligature 100 is attached to the mouthpiece 502. Therefore, each mass 112 is disposed generally adjacent the reed and spaced a given distance 614 from the reed by the flexible strap. Location of the mass adjacent the reed 504 dampens the vibration, i.e., the passband frequencies, of the flexible strap adjacent the reed. This prevents strap ligature vibrations from interfering with the vibration of the reed.

As is best illustrated in FIG. 6, the flexible strap forms a loop that encircles he mouthpiece 502 to secure the reed 504 to the mouthpiece. By drawing the masses and hence the ends of the flexible strap together, the strap tightens around the mouthpiece and the reed. As shown, each slot 122 within a given mass, extends into the mass partially along the non-diametric secant line 612. The non-diametric secant line does not pass through the center 604 of the circular cross section of the mass. In one embodiment, the secant line intersects a plane 610 tangent to the outer surface of the reed at a point 616 between the two ends or masses of the ligature at an angle 605 of from about 40° to about 45°. In one embodiment, the tangent point is disposed generally along the middle of the reed and preferably midway between the ends of the attached ligature. The non-diametric alignment in combination with the angle 605 translates the motion of bringing the ends and masses of the ligature together into both a constrictive force parallel to the plane 610 that tightens the flexible strap around the mouthpiece and a holding force perpendicular to the plane 610 that holds the reed against the mouthpiece.

The mouthpiece system includes a closure mechanism 506 that is in contact with and works in conjunction with the ligature to draw the ends and masses of the ligature together to tighten the ligature around the mouthpiece. In one embodiment, the closure mechanism is considered part of the ligature. Suitable closure mechanisms include clamps and threaded fasteners. Preferably, the closure mechanism is a threaded rod 510 that is passed through the holes 114 in each mass. The threaded rod has a head 511 that is larger than the diameter of the hole and threads along the distal end 513 to which a threaded thumbscrew 508 is attached. By turning the thumb screw in the proper direction, the masses are drawn together, applying a force that is decomposed into the constrictive force and perpendicular force and that tightens the ligature. In one embodiment, the alignment of the holes with respect to the slots 122 in conjunction with the closure mechanism function to define and to hold the angle 605 of the secant line with respect to the plane 610. Each hole 114 passes through the center 604 of the mass, and an angle 602 is defined between the center line 608 of the hole and the secant line 612 associated with the slot. This angle is the same as the angle 605 between the plane 610 and the secant line. Therefore, by establishing the hole and slot, the desired relationship between the masses, the flexible strap and the reed is established. In addition, the non-diametric alignment minimizes the amount of the ligature strap, either metal or flexible, that has to be cut or removed for the diametric hole that passes through each mass. Since the width of the ligature is selected to span as much of the length of the reed, preferably, the ligature is controlled along the entire width, i.e., the entire width contained within the slot. Therefore, any breaks in the contact between the ligature and the mass, for example the cut-outs required by the diametric mass holes, are minimized. Preferably, the breaks are limited to less than about 18% of the entire width of the ligature strap. In addition, the alignment and angle of the slot and hole form a bend in the ligature strap that spaces the masses from the reed and that function as an additional cushioning element between the masses and the reed.

Figure 7:
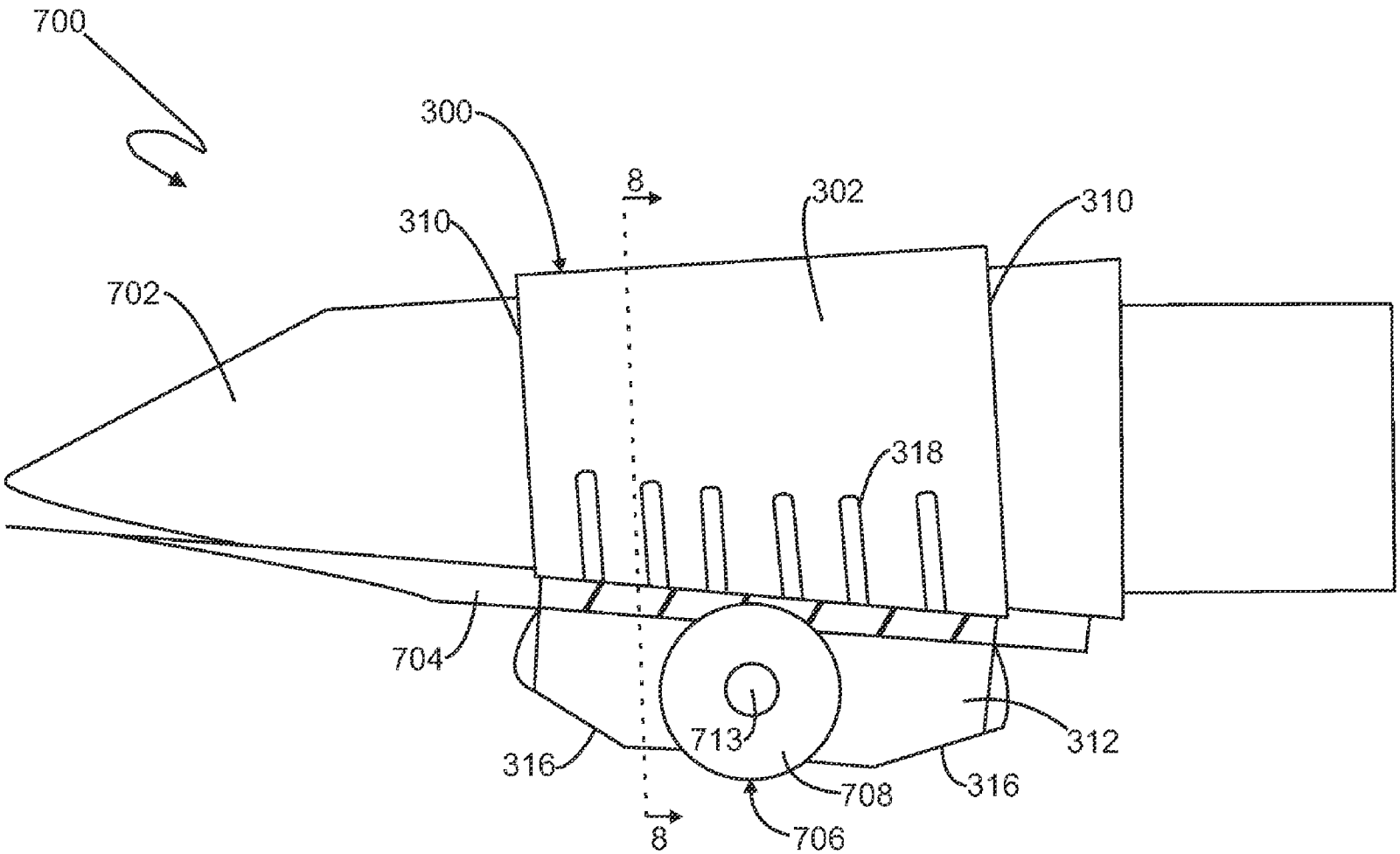
FIG. 7 is a side view of another embodiment of a mouthpiece system utilizing the ligature of FIG. 3.
Figure 8:
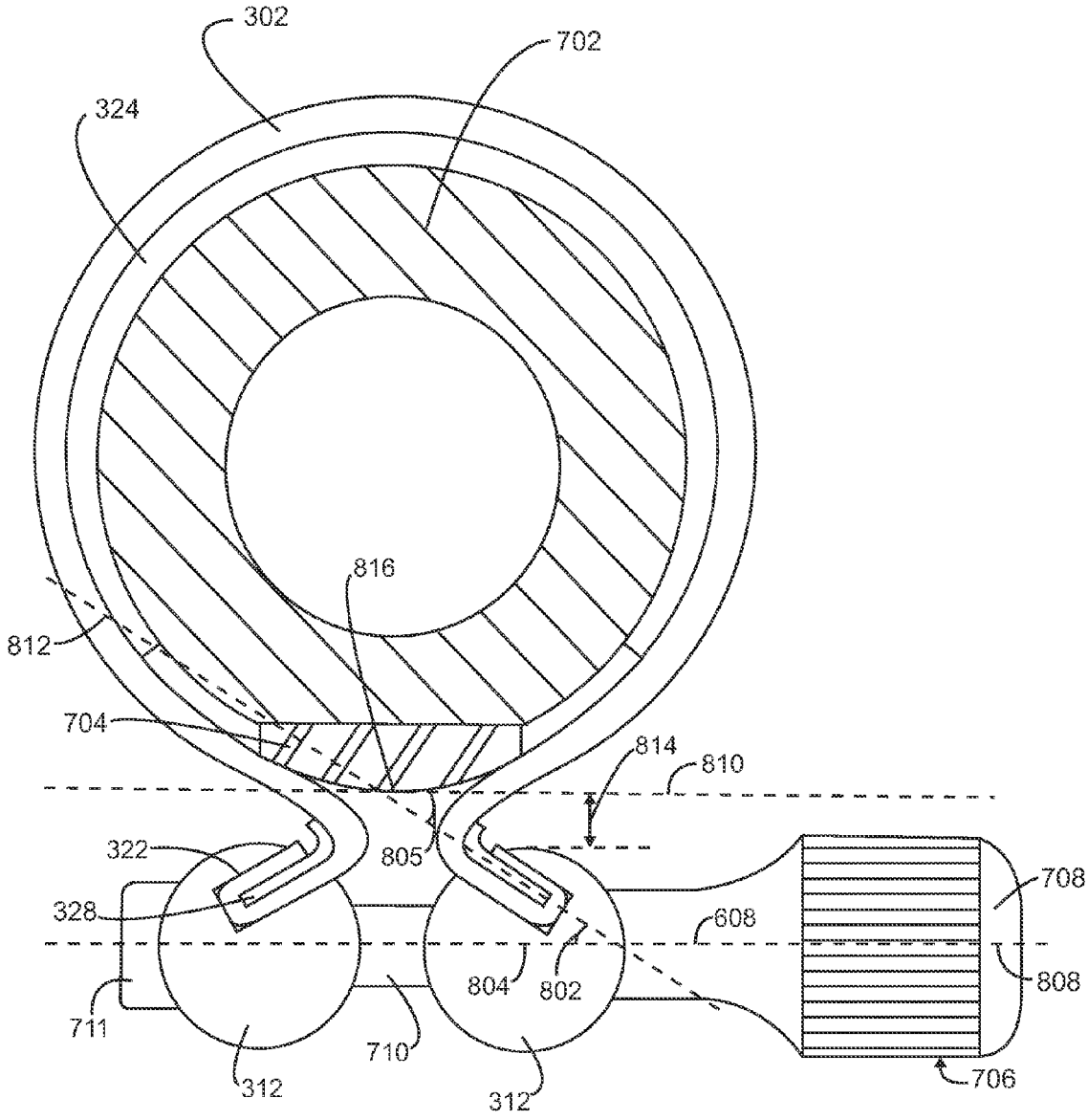
FIG. 8 is a view through line 8-8 of FIG. 7.

Referring to FIGS. 7 and 8, an exemplary embodiment of a woodwind mouthpiece system 700 utilizing the ligature in accordance with the present invention is illustrated. The system includes a mouthpiece 702, a reed 704 in contact with the mouthpiece and a ligature 300 surrounding the mouthpiece and the reed to secure the reed to the mouthpiece. In this embodiment, the ligature illustrated in FIGS. 3 and 4 is used. As illustrated, the ends of the flexible strap 302 are disposed over the reed 704 when the ligature 300 is attached to the mouthpiece 702. Therefore, each mass 312 is disposed generally adjacent the reed and spaced a given distance 814 from the reed by the flexible strap. Location of the mass adjacent the reed 704 in combination with the flexible insert 328 dampens the vibration, i.e., the passband frequencies, of the flexible strap adjacent the reed. This prevents strap ligature vibrations from interfering with the vibration of the reed.

As is best illustrated in FIG. 8, the flexible strap forms a loop that encircles he mouthpiece 702 to secure the reed 704 to the mouthpiece. By drawing the masses and hence the ends of the flexible strap together, the strap tightens around the mouthpiece and the reed. As shown, each slot 322 within a given mass, extends into the mass partially along the non-diametric secant line 812. The non-diametric secant line does not pass through the center 804 of the circular cross section of the mass. In one embodiment, the secant line intersects a plane 810 tangent to the outer surface of the reed at a point 816 between the two ends or masses of the ligature at an angle 805 of from about 40° to about 45°. In one embodiment, the tangent point is disposed generally along the middle of the reed and preferably midway between the ends of the attached ligature. The non-diametric alignment in combination with the angle 805 translates the motion of bringing the ends and masses of the ligature together into both a constrictive force parallel to the plane 810 that tightens the flexible strap around the mouthpiece and a holding force perpendicular to the plane 810 that holds the reed against the mouthpiece.

The mouthpiece system includes a closure mechanism 706 that is in contact with and works in conjunction with the ligature to draw the ends and masses of the ligature together to tighten the ligature around the mouthpiece. In one embodiment, the closure mechanism is considered part of the ligature. Suitable closure mechanisms include clamps and threaded fasteners. Preferably, the closure mechanism is a threaded rod 710 that is passed through the holes 314 in each mass. The threaded rod has a head 711 that is larger than the diameter of the hole and threads along the distal end 713 to which a threaded thumbscrew 708 is attached. By turning the thumb screw in the proper direction, the masses are drawn together, applying a force that is decomposed into the constrictive force and perpendicular force and that tightens the ligature. In one embodiment, the alignment of the holes with respect to the slots 322 in conjunction with the closure mechanism function to define and to hold the angle 805 of the secant line with respect to the plane 810. Each hole 314 passes through the center 804 of the mass, and an angle 802 is defined between the center line 808 of the hole and the secant line 812 associated with the slot. This angle is the same as the angle 805 between the plane 810 and the secant line. Therefore, by establishing the hole and slot, the desired relationship between the masses, the flexible strap and the reed is established.

The ligature of the present invention for affixing the reed to the mouthpiece of a saxophone or clarinet utilizes both heavy weighting and compliance elements to subdue the effect of internal resonances in the ligature, thereby improving the performance of the mouthpiece system. The mass-loading is as fully implemented as is practicable, and the arrangement of the ligature is simpler and more cost effective. The mass loading lowers the passband frequencies of the internal resonances of the ligature well below the passband frequencies of the reed when the instrument is being played, eliminating any tendency of the ligature resonances to counter the vibration of the reed. The result is a tonality of greater depth and greater musicality in combination with a decrease in any tendency to deviate from accuracy of intonation.

When the elements of the ligature that provide the compliant interface with the reed are backed by weighted elements, the negative effects of the high compliance are completely mitigated, and the player experiences complete control of the instrument's performance. By fastening the body of the ligature into a fold-back that partially encloses a spring-like cushion, an extremely compliant interface with the reed is achieved. The ends of the body are terminated into large, weighted rods, into which fastening means are incorporated.

While it is apparent that the illustrative embodiments of the invention disclosed herein fulfill the objectives of the present invention, it is appreciated that numerous modifications and other embodiments may be devised by those skilled in the art. Additionally, feature(s) and/or element(s) from any embodiment may be used singly or in combination with other embodiment(s) and steps or elements from methods in accordance with the present invention can be executed or performed in any suitable order. Therefore, it will be understood that the appended claims are intended to cover all such modifications and embodiments, which would come within the spirit and scope of the present invention.

What is claimed is:

1. A ligature for a mouthpiece, the ligature comprising:

a loop comprising a thin resilient flexible strap of rubberized fabric having two ends, the loop sized to encircle a mouthpiece; and a mass attached to the strap, the mass comprising an amount of weight selected to be large enough to lower passband frequencies of internal resonances of the ligature sufficiently below passband frequencies of a vibrating reed secured to the mouthpiece by the ligature and arranged as two substantially equal masses, each one of the two masses comprising a slot;

wherein each one of the two masses is attached to one of the two ends of the strap such that each end of the strap comprises an overlapping fold forming two layers of the strap and both layers of the strap are disposed and securely anchored in the slot.

2. The ligature of claim 1, wherein the mass is disposed on at least one of the two ends of the strap.

3. The ligature of claim 1, wherein each mass comprises a cylindrical rod.

4. The ligature of claim 3, wherein the strap further comprises two parallel sides running between the two ends, each cylindrical rod is aligned along each end to intersect each one of the two parallel sides at an angle other than 90° to create a frusto-conical shaped loop that accommodates for a tapered mouthpiece.

5. The ligature of claim 1, further comprising a metal shim disposed between the two layers of the strap at each end of the strap.

6. The ligature of claim 1, wherein the strap comprises metal and each end of the strap comprises an overlapping fold forming two layers of the strap, both layers disposed within the slot.

7. The ligature of claim 6, further comprising a strip of rubberized fabric disposed between the two layers of the strap at each end of the strap.

8. The ligature of claim 1, wherein each mass comprises a cylindrical rod and each slot extends along an entire length of the cylindrical rod and partially into the cylindrical rod along a non-diametric secant line.

9. The ligature of claim 8, wherein the ends of the strap are disposed over the reed when the ligature is attached to the mouthpiece, and the non-diametric secant line intersects a plane tangent to the outer surface of the reed at a point between the two ends of the ligature at an angle of from about 40° to about 45°.

10. A woodwind mouthpiece system comprising:

a mouthpiece;

a reed in contact with the mouthpiece;

a ligature surrounding the mouthpiece and the reed to secure the reed to the mouthpiece, the ligature comprising:

a loop comprising a thin resilient flexible strap of rubberized fabric having two ends, the loop encircling the mouthpiece and the ends of the strap disposed over the reed; and two substantially equal masses, each mass attached to one of the ends of the ends of the strap and spaced from the reed, the two masses in combination comprising an amount of weight selected to be large enough to lower passband frequencies of internal resonances of the ligature sufficiently below passband frequencies of the reed when vibrating and arranged as two substantially equal masses, each one of the masses comprising a slot;

wherein each one of the two masses is attached to one of the two ends of the strap such that each end of the strap comprises an overlapping fold forming two layers of the strap and both layers of the strap are disposed and securely anchored in the slot.

11. The mouthpiece system of claim 10, further comprising a metal shim disposed between the two layers of the strap at each end of the strap.

12. The mouthpiece system of claim 10, wherein the strap comprises metal and each end of the strap comprises an overlapping fold forming two layers of the strap, both layers disposed within the slot.

13. The mouthpiece system of claim 12, further comprising a strip of rubberized fabric disposed between the two layers of the strap at each end of the strap.

14. The mouthpiece system of claim 10, wherein each mass comprises a cylindrical rod and each slot extends along an entire length of the cylindrical rod and partially into the cylindrical rod along a non-diametric secant line.

15. The mouthpiece system of claim 14, wherein the ends of the strap are disposed over the reed when the ligature is attached to the mouthpiece, and the non-diametric secant line intersects a plane tangent to the outer surface of the reed at a point between the two ends of the ligature at an angle of from about 40° to about 45°.

* * * * *